US006026252A

United States Patent [19]

Kawai

[11] Patent Number: 6,026,252

[45] Date of Patent: Feb. 15, 2000

[54] IMAGE FORMING APPARATUS HAVING A PLURALITY OF PRELIMINARY PROCESSING STEPS FOR OVERCOMING AN IMAGE FORMATION DISABLED STATE

[75] Inventor: Atsushi Kawai, Toyokawa, Japan

[73] Assignee: Minolta Co., Ltd., Osaka, Japan

[21] Appl. No.: 09/037,965

[22] Filed: Mar. 11, 1998

[30] Foreign Application Priority Data

Mar. 12, 1997 [JP] Japan ..... 9-057615

[51] Int. Cl.[7] ..... G03G 15/00

[52] U.S. Cl. ..... 399/10; 399/18

[58] Field of Search ..... 399/9, 10, 11, 399/15, 16, 18, 21, 22, 27, 29, 34, 302, 303, 46, 47, 48, 49, 72, 42; 371/16.4

[56] References Cited

U.S. PATENT DOCUMENTS

| | | | |
|---|---|---|---|
| 4,202,622 | 5/1980 | Kawatsura et al. | 399/9 |
| 5,021,827 | 6/1991 | Komiya et al. | 399/11 |
| 5,166,934 | 11/1992 | Tomiyama et al. | 371/16.4 |
| 5,173,735 | 12/1992 | Kusumoto | 399/302 |
| 5,280,322 | 1/1994 | Kono | 399/22 |
| 5,499,079 | 3/1996 | Kinoshita et al. | 399/46 |
| 5,608,495 | 3/1997 | Kitakubo et al. | 399/72 |
| 5,610,689 | 3/1997 | Kamiya et al. | 399/42 X |

FOREIGN PATENT DOCUMENTS

| | | |
|---|---|---|
| 03029985 | 2/1991 | Japan . |
| 3-119862 | 10/1991 | Japan . |

*Primary Examiner*—Matthew S. Smith
*Assistant Examiner*—Hoan Tran
*Attorney, Agent, or Firm*—Burns, Doane, Swecker & Mathis, LLP

[57] ABSTRACT

An image forming apparatus electrophotographically forming a toner image on a record sheet based on original image information and being capable of performing one or more kinds of preliminary processing before switching to an image formation enabled state from an image formation disabled state caused by a trouble in the apparatus. The image forming apparatus includes (1) a detecting device for detecting the trouble; a memory for storing the state of the trouble; and a preliminary processing determining portion for determining the kind of the preliminary processing to be performed based on the state of the trouble stored in the memory, or includes (2) a detecting device for detecting the trouble; a trouble determining portion for determining whether the trouble occurred in an adjustment mode for adjusting the image forming apparatus; and a preliminary processing determining portion for determining the kind of the preliminary processing to be performed based on a result of the determination by the trouble determining portion.

24 Claims, 4 Drawing Sheets

IMAGE FORMING APPARATUS HAVING A PLURALITY OF PRELIMINARY PROCESSING STEPS FOR OVERCOMING AN IMAGE FORMATION DISABLED STATE

This application is based on patent application No. 9-57615 Pat. filed in Japan, the contents of which is hereby incorporated.

BACKGROUND OF THE INVENTION

1. Field of the Invention

The present invention relates to image forming apparatuses such as electrophotographic copying machines and printers, and particularly relates to an image forming apparatus, which can perform preliminary processing in such a case that the image forming operation of the image forming apparatus is disabled, for example, due to jamming or another trouble, and more specifically can perform the preliminary processing for normally or accurately performing the subsequent image formation before the disabled image forming apparatus is enabled to perform the image forming operation.

2. Description of the Background Art

In an electrophotographic image forming apparatus such as a full-color copying machine, a toner image corresponding to an original image is formed on a record sheet, for example, in the following manner. An image reader reads the image on an original document which is located at a predetermined position. Based on original image information thus read, electrostatic latent images which correspond to several colors (e.g., cyan, magenta, yellow and black) of the original image, respectively, are formed on an electrostatic latent image carrier such as a photosensitive member. Every time the electrostatic latent image corresponding to one of the colors is formed, development is performed by a developing device, which accommodates toner of the same color, to form a toner image of the same color on the electrostatic latent image carrier. The toner image thus formed is transferred onto the sheet carried on a sheet carrying member such as a transfer drum. In this manner, the toner images of the respective colors corresponding to the original image are formed on the sheet in a superposed fashion. Usually, the toner images on the sheet are fixed thereto by a heat, pressure or the like.

This copying machine may attain such states that the copying cannot be performed, or the copying operation is disabled due to a certain reason. These states will be referred to as the copying disabled state, hereinafter. Before the copying machine is restored from the copying disabled state to a copying enabled state in which execution of the copying operation is enabled, preliminary processing, which will be described later, may be performed for normally or accurately performing the copying operation before a subsequent copying operation is executed. A copying machine which can perform such preliminary processing before enabling the copying operation has been proposed.

When power switch of the copying machine is off, the copying machine is usually disabled. Also, a sheet may be jammed within the copying machine during transportation for the copying operation. Further, the machine may detect that the sheet is not correctly carried on the sheet carrying member such as a transfer drum during copying, or that a rotary member (e.g., the photosensitive drum or the transfer drum) to be driven does not operate correctly during the copying. In these states, the copying machine stops the copying operation, and is set to the copying disabled state.

Even during a period for which the copying is not being performed, the copying machine is usually disabled when a certain trouble is detected. Troubleshooting is performed as follows. For example, in the case of jamming, a cover or door of the copying machine is opened for removing the jammed sheet. If the cover or the like is left open even after removal of the jammed sheet or other recovery processing, the copying machine is usually disabled because one may receive an electric shock by touching a portion carrying a high voltage, or may burn himself or herself by touching a hot portion.

More specifically, the preliminary processing performed by the copying machine described above may be performed as described in the following items (1)–(3).

(1) Processing is performed to determine whether a remaining sheet is present on the sheet carrying member such as a transfer drum for preventing such a state that the record sheet is not correctly held on the sheet carrying member such as a transfer drum during the next copying and is jammed thereon due to the sheet remaining on the sheet carrying member. For this purpose, a sensor or the like is usually arranged at a fixed position opposed to the surface of the sheet carrying member for determining whether a sheet is present on the surface of the sheet carrying member such as a transfer drum. However, the sheet is usually carried on the sheet carrying member without fully covering the entire surface thereof. Therefore, the sheet remaining on the sheet carrying member may not be detected in some cases. For preventing such failure in detection, the carrying member is, for example., driven to rotate for reliably detecting the residual sheet.

(2) Processing is performed to form a toner pattern on the electrostatic latent image carrier such as a photosensitive drum, which is driven to rotate, under predetermined image forming conditions. The density of the toner pattern is detected by an AIDC sensor or the like, and the detected density is used to determine the image forming conditions for the next copying operation such as a developing bias voltage in the developing device, and a quantity of laser beams emitted from a laser device for emitting the laser beams onto the electrostatic latent image carrier to form the electrostatic latent image. These conditions are determined to attain an appropriate density of the toner image formed on the record sheet in the next copying operation and, in other words, to prevent an excessively large or small density.

(3) Processing is performed to remove toner which adhered onto the surface of the sheet carrying member such as a transfer drum as a result of the copying operation. This processing is performed for preventing smearing of the sheet by the adhered toner in the next copying operation. Usually, removal of the toner for preventing smearing of the sheet in the next copying operation is performed at the last step in the copy sequence when the copying is correctly completed without any trouble. If the copying operation is interrupted due to a trouble or the like, this removal processing is not performed, and therefore the above preliminary processing is performed for the next copying operation.

The copying machine starts the above kinds of preliminary processing, for example, after it is powered on or after a cover, door or the like which was opened for recovery from the trouble or the like is closed.

As described above, the foregoing kinds of preliminary processing (1)–(3) are performed in the copying machine before the next copying operation is enabled again so that the next copying can be performed normally and correctly by removing the cause of trouble disabling the copying operation. This copying machine cannot start the copying operation until completion of the preliminary processing, and a user must wait for a certain time until the machine to be enabled, which impedes easy use and operation.

The above description has been given on the copying machine provided with the sheet carrying member such as a transfer drum. Similar problems may arise in image forming apparatuses such as a printer other than the copying machine, apparatuses such as a copying machine and a printer not provided with a sheet carrying member (e.g., a transfer drum), and image forming apparatuses such as a copying machine and a printer provided with intermediate transfer members, if these apparatuses perform the preliminary processing for the above purposes.

SUMMARY OF THE INVENTION

Accordingly, an object of the invention is to provide an image forming apparatus for electrophotographically forming an image on a sheet based on original image information, wherein one or more kinds of preliminary processing can be performed before switching to an image formation enabled state from an image formation disabled state caused by a trouble in the apparatus. More specifically, the apparatus can perform necessary preliminary processing in accordance with the trouble, and thereby can rapidly complete the preliminary processing in accordance with the trouble so that the image formation is rapidly enabled and a waiting time before the image formation enabled state can be short, which achieves easy operation and use of the image forming apparatus.

According to one aspect of the invention, there is provided an image forming apparatus (i.e., first image forming apparatus) electrophotographically forming a toner image on a record sheet based on original image information and being capable of performing one or more kinds of preliminary processing before switching to an image formation enabled state from an image formation disabled state caused by a trouble in the apparatus. The image forming apparatus comprises a detecting device for detecting the trouble causing the image formation disabled state of the image forming apparatus; a memory for storing the state of the trouble detected by the detecting device; and a preliminary processing determining portion for determining the kind of the preliminary processing to be performed based on the state of the trouble stored in the memory.

According to another aspect of the invention, there is provided an image forming apparatus (i.e., second image forming apparatus) electrophotographically forming a toner image on a record sheet based on original image information and being capable of performing one or more kinds of preliminary processing before switching to an image formation enabled state from an image formation disabled state caused by a trouble in the apparatus. The image forming apparatus comprises a detecting device for detecting the trouble causing the image formation disabled state of the image forming apparatus; a trouble determining portion for determining whether the trouble detected by the detecting device occurred in an adjustment mode for adjusting the image forming apparatus; and a preliminary processing determining portion for determining the kind of the preliminary processing to be performed based on a result of the determination by the trouble determining portion.

In each of the foregoing image forming apparatuses, the image forming apparatus is switched from the image formation enabled state to the image formation disabled state when the detecting device detects a trouble requiring disabling of the image formation. Thus, the image formation of the image forming apparatus is disabled in response to the state of the trouble occurred in the apparatus.

When the trouble is eliminated by a user, a serviceman or the like, the detecting device detects the trouble no longer. Thereby, the image forming apparatus can be restored to the image formation enabled state.

In this case, one or more kinds of the preliminary processing are executed for normally and correctly performing the next image formation before the image formation is enabled.

In the first image forming apparatus, the kind(s) of the preliminary processing, which is necessary and is to be actually performed for normally and correctly performing the next image formation, is selected and determined by the preliminary processing determining portion based on the state of the trouble stored in the memory. After the preliminary processing thus determined is performed, the image forming apparatus is enabled to perform the image formation.

In the second image forming apparatus, the preliminary processing determining portion likewise determines the kind of preliminary processing to be performed based on the result of determination of the trouble determining portion, and the image forming apparatus is enabled to perform the image formation after the determined preliminary processing is performed.

The first image forming apparatus does not perform the unnecessary kinds of processing which are determined based on the state of trouble stored in the memory. The second image forming apparatus does not perform the unnecessary kinds of processing which are determined based on the result of determination of the trouble determining portion. Owing to them, the image forming apparatuses can be enabled rapidly to perform the image formation. If no preliminary processing is required in view of the state of trouble, the preliminary processing determining portion determines that no preliminary processing is to be performed, and the image formation is enabled without performing the preliminary processing.

The foregoing and other objects, features, aspects and advantages of the present invention will become more apparent from the following detailed description when taken in conjunction with the accompanying drawings.

DESCRIPTION OF THE PREFERRED EMBODIMENTS

Figure 1:
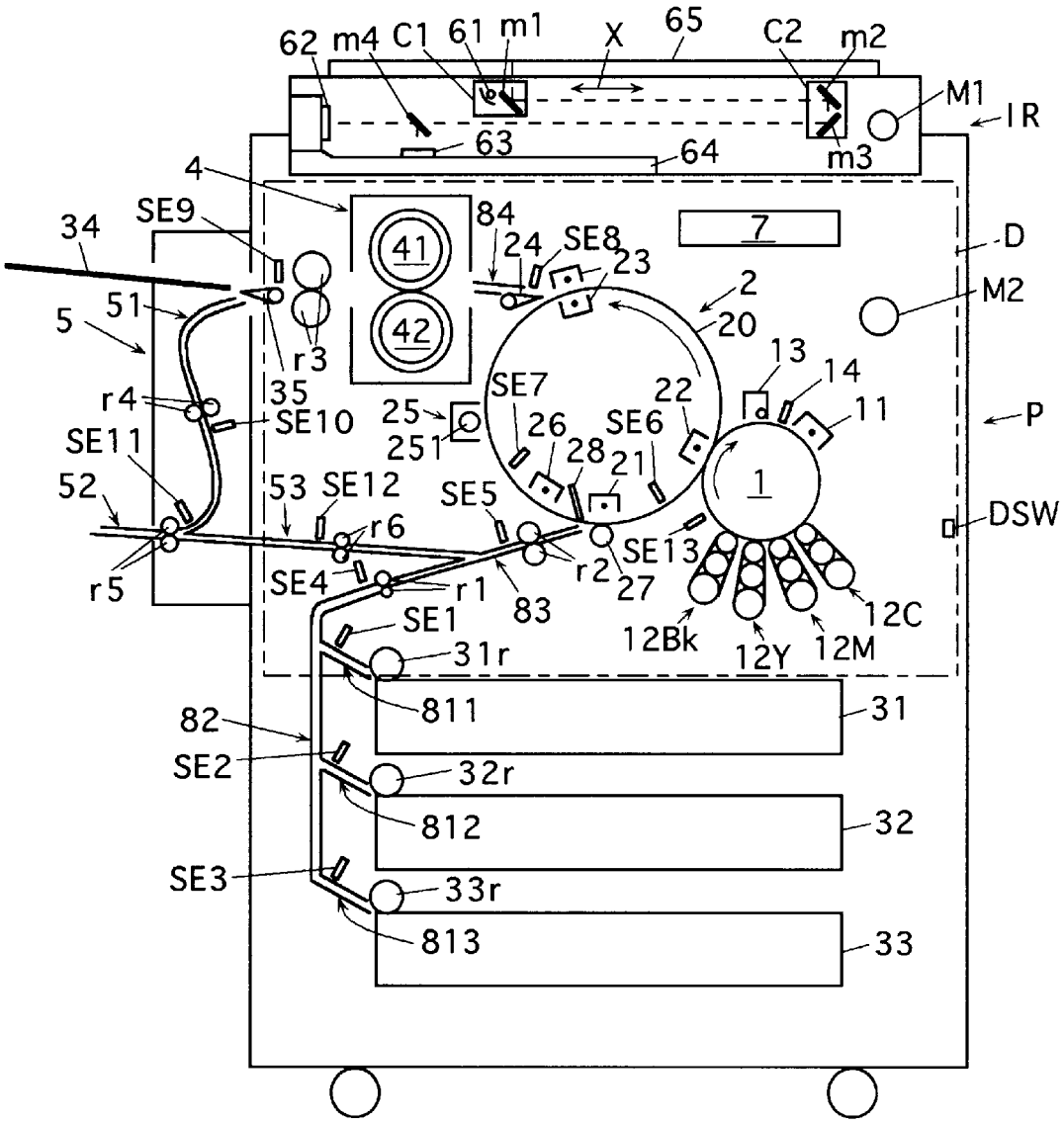
FIG. 1 schematically shows an example of a structure of a digital full-color copying machine according to one embodiment of the invention.

An image forming apparatus of a first type is an apparatus electrophotographically forming a toner image on a record sheet based on original image information and being capable of performing one or more kinds of preliminary processing before switching to an image formation enabled state from an image formation disabled state caused by a trouble in the apparatus. The image forming apparatus comprises a detecting device for detecting a trouble causing the image formation disabled state of the image forming apparatus; a memory for storing the state of the trouble detected by the detecting device; and a preliminary processing determining portion for determining the kind of the preliminary processing to be performed based on the state of the trouble stored in the memory.

An image forming apparatus of a second type is an apparatus electrophotographically forming a toner image on a record sheet based on original image information and being capable of performing one or more kinds of preliminary processing before switching to an image formation enabled state from an image formation disabled state caused by a trouble in the apparatus. The image forming apparatus comprises a detecting device for detecting a trouble causing the image formation disabled state of the image forming apparatus; a trouble determining portion for determining whether the trouble detected by the detecting device occurred in an adjustment mode for adjusting the image forming apparatus; and a preliminary processing determining portion for determining the kind of the preliminary processing to be performed based on a result of the determination by the trouble determining portion.

The image forming apparatus may be, for example, a copying machine, a printer, a facsimile machine or a composite machine thereof. Any of these machines and apparatuses may be of either a monochrome type or a color (multicolor) type.

The foregoing original image information is information of an image on an original document which is laid at a predetermined position and is read by an image reader, if the image forming apparatus is a copying machine. If it is a printer, the original image information is information of an original image which is supplied from an equipment such as a computer connected to the printer. If it is a facsimile machine, the original image information is information of an original image which is supplied from a sending facsimile machine through a telephone line or the like.

In each of the image forming apparatuses, when the detecting device detects a trouble requiring disabling of the image formation, the image forming apparatus is switched from the image formation enabled state to the image formation disabled state. Thus, the image forming apparatus is disabled due to a failure occurring at the apparatus.

The image formation disabled state represents such a state that the image formation cannot be started even when a user depresses or touches a switch or a key (i.e., a start key) provided at the image forming apparatus for instructing start of the image formation, and also includes such a state that the image forming apparatus is powered off and therefore the image formation cannot be performed. The image formation enabled state represents such a state that the image formation can start when the start switch or the like is depressed to instruct the start of the image formation.

The foregoing troubles are specifically such states that the record sheet is jammed during transportation and that an outer door, cover or the like of the image forming apparatus is open, and also include such a state that the power switch is off. When the trouble is detected, the image forming apparatus of the first type stores the state of the trouble in the memory.

When the detecting device detects the trouble no longer owing to troubleshooting by a user, serviceman or the like, the image forming apparatus can be enabled to perform the image formation again.

Before enabling the image formation, one or more kinds of preliminary processing are performed for normally and accurately performing the next image formation. In the first image forming apparatus, the kind(s) of the preliminary processing, which is necessary and is to be actually performed for normally and correctly performing the next image formation, is selected and determined by the preliminary processing determining portion based on the state of trouble stored in the memory. After the preliminary processing thus determined is performed, the image forming apparatus is enabled to perform the image formation. The preliminary processing determining portion may be provided with a look-up table showing a relationship between the states of trouble and the kinds of preliminary processing to be performed, and the preliminary processing to be performed may be determined from the look-up table based on the state of trouble.

In the second image forming apparatus, the preliminary processing determining portion likewise determines the kind of preliminary processing to be performed based on the result of determination of the trouble determining portion, and the image forming apparatus is enabled to perform the image formation after the determined preliminary processing.

The first image forming apparatus does not perform unnecessary kinds of processing which are determined based on the state of trouble stored in the memory. The second image forming apparatus does not perform unnecessary kinds of processing which are determined based on the result of determination of the trouble determining portion. Owing to them, the image forming apparatuses can be enabled rapidly to perform the image formation. If no preliminary processing is required in view of the state of trouble, the preliminary processing determining portion determines that no preliminary processing is to be performed, and the image formation is enabled without performing the preliminary processing.

The image forming apparatus may operate as follows. An electrostatic latent image is formed on an electrostatic latent image carrier based on the original image information, the electrostatic latent image is developed into a toner image, the toner image is transferred onto the record sheet carried on the sheet carrying member opposed to the electrostatic latent image carrier, and the toner image based on the original image is formed on the record sheet. In this image forming apparatus, the preliminary processing may be specifically performed as described in the following items (1)–(3).

(1) Processing is performed to determine whether a remaining sheet is present on the sheet carrying member.

If the sheet carrying member is, for example, an endless rotary member and is driven to rotate by a drive device, a sensor (e.g., a sensor of reflection type) is opposed to the sheet carrying member. This sensor detects presence/absence of the sheet while rotating the sheet carrying member by the drive device.

(2) Processing is performed for optimizing a toner density of the toner image formed on the record sheet.

For example, a density detecting device (e.g., an AIDC sensor) is employed for this toner density optimizing processing. This density detecting device is arranged at a position opposed to the electrostatic latent image carrier for detecting the density of the toner image formed on the electrostatic latent image carrier. A toner pattern is formed on the electrostatic latent image carrier under predetermined image forming conditions. The density detecting device detects the density of the toner pattern, and image formation conditions for intended image formation (i.e., in the next image formation) are determined based on the detected density of the toner pattern. The image formation conditions are conditions affecting the toner density and are, for example, a developing bias voltage applied in the process of developing the electrostatic latent image into the toner image, and a quantity of laser beams emitted from a laser device for irradiating the electrostatic latent image carrier with the laser beams to form the electrostatic latent image.

(3) I) processing is performed for cleaning the sheet carrying member.

For this cleaning processing, the apparatus is provided, for example, with a toner removing device for removing toner adhered onto the surface of the sheet carrying member and/or a charge erasing device for erasing the residual charges on the surface of the sheet carrying member. The toner removing device removes the toner adhered onto the surface of the sheet carrying member, and/or the charge erasing device erases the residual charges on the surface of the sheet carrying member.

The image forming apparatus of the first type which can perform the above kinds of preliminary processing (1)–(3) may be the following image forming apparatus, wherein an electrostatic latent image is formed on the electrostatic latent image carrier based on the original image information, the electrostatic latent image is developed into the toner image, the toner image is transferred onto the record sheet carried on the surface of the sheet carrying member opposed to the electrostatic latent image carrier, and the toner image based on the original image is formed on the record sheet, and wherein one or more kinds of preliminary processing can be performed before switching to the image formation enabled state from the image formation disabled state caused by a trouble in the apparatus. This image forming apparatus comprises the detecting device for detecting a trouble causing the image formation disabled state of the image forming apparatus; the memory for storing the state of the trouble detected by the detecting device; and the preliminary processing determining portion for determining the kind of the preliminary processing to be performed based on the state of the trouble stored in the memory. The preliminary processing determining portion selectively determines three kinds of the preliminary processing which are (1) sheet detection for detecting whether the record sheet is present on the sheet carrying member or not, (2) optimization of the toner density for optimizing the density of the toner image formed on the record sheet, and (3) cleaning of the sheet carrying member.

This image forming apparatus may be provided with a sheet transporting device, which can transport the sheet from the sheet accommodating position, at which the record sheet for forming the toner image thereon is accommodated, to a sheet carrying position, at which the record sheet is carried on the sheet carrying member, and after the toner image is formed on the record sheet, this sheet transporting device can transport the record sheet carried on the sheet carrying member to a sheet discharge position outside the image forming apparatus. In this case, the preliminary processing determining portion may selectively determine the following matters (a)–(f) for the above kinds of the preliminary processing (1)–(3) in accordance with the state of trouble stored in the memory.

(a) When the memory stores, as the trouble, the jamming forcedly caused during an operation of adjusting the position of the record sheet on the surface of the sheet carrying member and adjusting the position of the toner image on the record sheet, the preliminary processing determining portion determines that no preliminary processing is to be performed.

(b) The memory stores, as the trouble, the jamming which occurred during transportation of a first sheet from the sheet accommodating position to the sheet carrying position by the sheet transporting device for the image formation on the first sheet. In this case, the preliminary processing determining portion determines that the toner density optimizing processing is to be performed. In the case where image formation is to be performed on a plurality of sheets, the "first sheet" is literally the first sheet on which the first image forming processing is effected. In the case where image formation is to be performed on a single sheet, the "first sheet" is this single sheet.

(c) The memory stores, as the trouble, the jamming which occurred during transportation of the last sheet from the sheet carrying member to the sheet discharging position by the sheet transporting device for the image formation on the last sheet. In this case, the preliminary processing determining portion determines that the toner density optimizing processing and the cleaning processing are to be performed. In the case where image formation is to be performed on a plurality of sheets, the "last sheet" is literally the last sheet on which the last image forming processing is effected. In the case where image formation is to be performed on a single sheet, the "last sheet" is this single sheet.

(d) The sheet transporting device includes a device for inverting and transporting the record sheet to the sheet carrying position after the toner image is formed on the sheet. The memory stores, as the trouble, the jamming which occurred during transportation of the sheet to the sheet carrying position by the sheet transporting device after inverting the record sheet. In this case, the preliminary processing determining portion determines that the toner density optimizing processing and the cleaning processing are to be performed.

(e) The memory stores, as the foregoing trouble, the trouble which was detected by the detecting device while the image formation was not being performed. In this case, the preliminary processing determining portion determines that the toner density optimizing processing is to be performed.

(f) The memory stores, as the foregoing trouble, the trouble caused during adjustment of the image forming apparatus which was carried out without performing transportation of the record sheet by the sheet transporting device. In this case, the preliminary processing determining portion determines that no preliminary processing is to be performed.

A specific example of the image forming apparatus according to the invention will be described below with reference to the drawings.

FIG. 1 schematically shows an internal structure of a digital full-color copying machine of an embodiment of the invention.

This copying machine includes an image reader IR for reading an image of an original document which is laid on an original table 65 arranged at an upper position of the copying machine, and a printer P for electrophotographically forming a toner image on a record sheet based on the original image read by the image reader IR.

The image reader IR includes an illumination lamp 61 for illuminating the original document laid on the original table 65, mirrors m1, m2 and m3 for leading light beams reflected by the original to a converging optical unit 62, a mirror m4 for leading the light beams converged by the converging optical unit 62 to a full-color CCD sensor 63 for converting the original image light into electric signals, and an image signal processing unit 64 which can temporarily store the electric signals produced by the CCD sensor 63 and can perform processing such as image processing. The lamp 61 and the mirror m1 are carried by a carriage C1, and the mirrors m2 and m3 are carried by a carriage C2. The carriages C1 and C2 can be reciprocated independently of each other by a scan motor M1 in a secondary scanning (subscanning) direction X parallel to the original table 65.

Image reading by the image reader IR is performed as follows. The lamp 61 carried on the carriage C1 is turned on, and the carriage C1 is driven at a predetermined speed in the secondary scanning direction X. The carriage C2 is driven in the same direction at half a speed of the carriage C1. Thereby, the original is scanned. During this, the light beams reflected by the original are lead to the CCD sensor 63 successively through the mirrors m1, m2, m3, m4 and the converging optical unit 62, and the sensor 63 reads the image focused thereon. In the CCD sensor 63, red (R), green (G) and blue (B) light beams of the input image light are converted into analog electric signals, respectively, and are supplied to the image signal processing unit 64. In the image signal processing unit 64, the analog electric signals for the respective colors corresponding to the original image are converted into digital signals for the respective colors corresponding to the original image, and are temporarily stored in the memory (not shown). The image signal processing unit 64 produces a laser drive signal for forming electrostatic latent images, which correspond to colors of cyan (C), magenta (M), yellow (Y) and black (Bk) of the original image, respectively, on the photosensitive drum 1, which will be described later, based on the original image information relating to the respective colors (R, G and B) in the memory. These laser drive signals are sent to the laser device 7 which emits the laser light beams onto the photosensitive drum 1 to form the electrostatic latent images.

The printer P includes the photosensitive drum 1, the laser device 7 for successively emitting the laser light beams, which correspond to the respective colors (C, M, Y and Bk) of the original image, onto the surface of the photosensitive drum 1 to form the electrostatic latent images based on the signals sent from the image signal processing portion 64, various equipments which are arranged around the photosensitive drum 1 and will be described later, sheet trays 31, 32 and 33 accommodating the record sheets on which toner images are to be formed, a fixing device 4 for fixing the toner image transferred onto the sheet, and a sheet resupplying and inverting unit 5 for forming images on both sides of the sheet.

Around the photosensitive drum 1, there are arranged, in the following order, an electric charger 11, developing devices (i.e., cyan, magenta, yellow and black developing devices 12C, 12M, 12Y and 12Bk) which accommodate toner of cyan, magenta, yellow and black for the full-color development, respectively, a transfer drum 2 attracting and holding the sheet on the surface thereof, a cleaner 13 for removing toner remaining on the photosensitive drum 1, and a main eraser 14 for erasing the electric charges remaining on the photosensitive drum 1.

In this embodiment, each of the four developing devices uses toner and carrier, and thus is of a two-component developing type. An ATDC (Automatic Toner Density Control) sensor (not shown) is arranged is at a lower portion of each developing device for detecting a toner density and thereby maintaining a constant density of toner in the developing device. When the ATDC sensor detects that the toner density is lower than a reference value, the toner is supplied from a toner hopper provided for the developing device. An AIDC (Automatic Image Density Control) sensor SE13 is arranged between the black developing device 12Bk and the transfer drum 2 for detecting a density of a toner pattern which is formed on the photosensitive drum 1 for density detection. The AIDC sensor SE13 issues a detection signal to a computer CP, which will be described later, for use, e.g., in processing for stabilizing an image as will be described later.

The photosensitive drum 1 and the transfer drum 2 are driven to rotate by a drum motor M2. During the image formation, the photosensitive drum 1 is driven to rotate clockwise in FIG. 1, and the transfer drum 2 is driven to rotate counterclockwise in FIG. 1.

The transfer drum 2 is formed of a transfer film 20 which is retained around a frame (not shown) in a drum-like form. The transfer film 20 is in contact with a portion of the surface of the photosensitive drum 1 between the developing device 12Bk and the cleaner 13.

At a position where the transfer film 20 is in contact with the photosensitive drum 1, a transfer charger 22 is arranged on an inner side of the film 20 for transferring the toner image formed on the photosensitive drum 1 onto the sheet held on the outer surface of the film 20.

At a position upstream in the surface moving direction (counterclockwise direction in FIG. 1) of the transfer film 20, there is arranged an electrostatic attraction charger 21 which is located inside the film 20 for attracting the sheet, onto which the toner image will be transferred at the transfer position, onto the outer surface of the film 20, and is also arranged an attraction roller 27 opposed to the charger 21 with the film 20 therebetween. At a further upstream position, there is arranged an attraction backup film 28 which is located inside the transfer film 20 for slightly pushing up the film 20 and thereby promoting attraction of the sheet onto the outer surface of the film 20. The attraction backup film 28 can be brought into contact with and moved away from the transfer film 20 by a moving device (not shown).

At a region downstream from the transfer position in the surface moving direction of the transfer film 20, there are arranged a pair of separator chargers 23, which are located inside and outside the film 20 for promoting separation of the sheet attracted onto the outer surface of the transfer film 20, a separator claw 24 located outside the film 20 for separating the sheet attracted onto the outer surface of the transfer film 20, a fur brush unit 25 located outside the film 20 and having a fur brush roller 251 for removing and cleaning toner or the like adhered onto the outer surface of the transfer film 20, and a charge removing charger 26 located inside the transfer film 20 for removing residual charges of the film 20. The separator claw 24 is pivotably carried, and can be brought into contact with and spaced from the transfer film 20 by a moving device (not shown). The fur brush roller 251 can be brought into contact with and spaced from the transfer film 20 by a moving device (not shown).

Inside the transfer film 20, there is stationarily arranged a sensor SE6 located between the sheet attraction position, where the electrostatic attraction charger 21 and the attraction roller 27 are opposed to each other, and the transfer position. The sensor SE6 in this embodiment is an optical sensor, and can determine whether light emitted from a light emitting device included therein is reflected thereto or not, and thereby can determine whether the sheet has been attracted onto the outer surface of the transfer film 20 at the position opposed to the sensor SE6 or not. The transfer film 20 is optically transparent. A sensor SE7 is arranged inside the transfer film 20 for detecting a projection (not shown) arranged at the inner periphery of the transfer drum 2. A reference position of the transfer drum 2 can be determined based on a detection signal sent from the sensor SE7. The reference position is utilized for positioning the image formed on the photosensitive drum 1 and the sheet held on the transfer drum 2 with respect to each other. The detection signals issued from the sensors SE6 and SE7 are sent to the computer CP, which will be described later.

The sheet trays 31, 32 and 33 accommodate the sheets for image formation in stacked forms, respectively. Sheet transporting paths 82 and 83 extend from the sheet tray to the sheet attraction position. The sheets accommodated in the tray 31 can be fed by a roller 31r to the transportation path 82 through a transportation path 811. Likewise, the sheets accommodated in the tray 32 can be fed by a roller 32r to the transportation path 82 through a transportation path 812. The sheets accommodated in the tray 33 can be fed by a roller 33*r* to the transportation path 82 through a transportation path 813. For the transportation path 83, there are arranged an intermediate roller pair r1 and a timing roller pair r2, which can transport the sheets, which are fed from the sheet tray, to the sheet attraction position.

Sensors SE1, SE2 and SE3 are arranged at positions, where the transportation paths 811, 812 and 813 are joined to the transportation path 82, for detecting the sheets located at these positions, respectively. A sensor SE4 is arranged at a position immediately before the intermediate roller r1 in the sheet transporting direction for detecting the sheet present at this position. A sensor SE5 is arranged at a position immediately before the timing roller pair r2 in the sheet transporting direction for detecting the sheet present at this position. These sensors SE1, SE2, SE3, SE4 and SE5 issue the detection signals to the computer CP which will be described later.

The fixing device 4 has a heating roller 41 which can be heated to a predetermined fixing temperature, and a pressing roller 42 pushed against the roller 41. The heating roller 41 can be driven to rotate by a fixing motor (not shown).

A transporting path 84 is arranged between the sheet separating position, where the separator claw 24 is opposed to the transfer film 20, and the fixing device 4. The sheet separated from the transfer film 20 by the separating claw 24 can be sent through the transportation path 84 to a nip between the heating and pressing rollers 41 and 42 of the fixing device 4. A sensor SE8 is arranged between the sheet separating position and the fixing device 4 for detecting the sheet present at this position. The sensor SE8 issues a detection signal to the computer CP which will be described later.

The sheet, which passed through the position between the heating and pressing rollers 41 and 42 of the fixing device 4, can be sent onto the discharge tray 34 or to a transporting path 51 within the sheet resupplying and inverting unit 5 by a discharge roller r3 arranged at a downstream position. Selection of the sheet transporting direction can be performed by a pivotable claw 35 which is arranged at a diverging position between the discharge tray 34 and the transporting path 51. The claw 35 is swung by a solenoid (not shown). A sensor SE9 is arranged downstream from the discharge roller r3 in the sheet transporting direction for detecting the sheet present at this position. The sensor SE9 issues a detection signal to the computer CP which will be described later.

The sheet resupplying and inverting unit 5 is provided for forming images on both sides of the sheet, and is operable to invert the sheet, which already carries an image on its front (first) surface, and resupply the same to the sheet attraction position. The unit 5 includes the S-shaped transporting path 51 as well as a transporting path 52 extending from the transporting path 51 and a transporting path 53, which has an end at a joint between the transporting paths 51 and 52, extends away from the transporting path 52 along an extension of the path 52, and is joined to a transporting path 83. The sheet fed to the transporting path 51 is temporarily fed to the transporting path 52 by a roller pair r4 arranged at the transporting path 51 and a roller pair r5 arranged at a joint between the transporting paths 51 and 52. When the sheet is thereafter to be fed to the transporting path 53, the roller pair r5 is reversely rotated to feed the sheet to the transporting path 53. In this manner, the sheet is fed to the transporting path 53, and is fed to the transporting path 83 by a roller pair r6 arranged at the path 53. Thereby, the sheet thus fed can be supplied to the sheet attraction position after inverting the sheet from the position supplied from the sheet tray 31, 32 or 33.

A sensor SE10 is arranged at a position downstream from the roller pair r4 in the sheet transporting direction. A sensor SE11 is arranged at a position upstream to the roller pair r5, and a sensor SE12 is arranged at a position upstream to the roller pair r6. These sensors SE10, SE11 and SE12 can detect the sheets at these positions, respectively, and issue the detection signals to the computer CP which will be described later.

Although not shown, a sheet supply motor is arranged for driving and rotating the sheet supply rollers 31r, r32, 33r, roller pair r1, timing roller pair r2, discharge roller pair r3 and roller pairs r4, r5 and r6 which are used for sheet transportation and others.

At a front side of the copying machine, there is arranged an openable door D located under the image reader IR and above the sheet tray 31. When the door R is open, one can access an area in the copying machine, through which the sheet is transported as described above, for removable of a jammed sheet and a maintenance. A door switch DSW which is closed and opened in response to closing and opening of the door is arranged for the door D. The door switch DSW can detect the opened and closed states of the door D, and the detected information is sent to the computer CP which will be described later.

Figure 2:
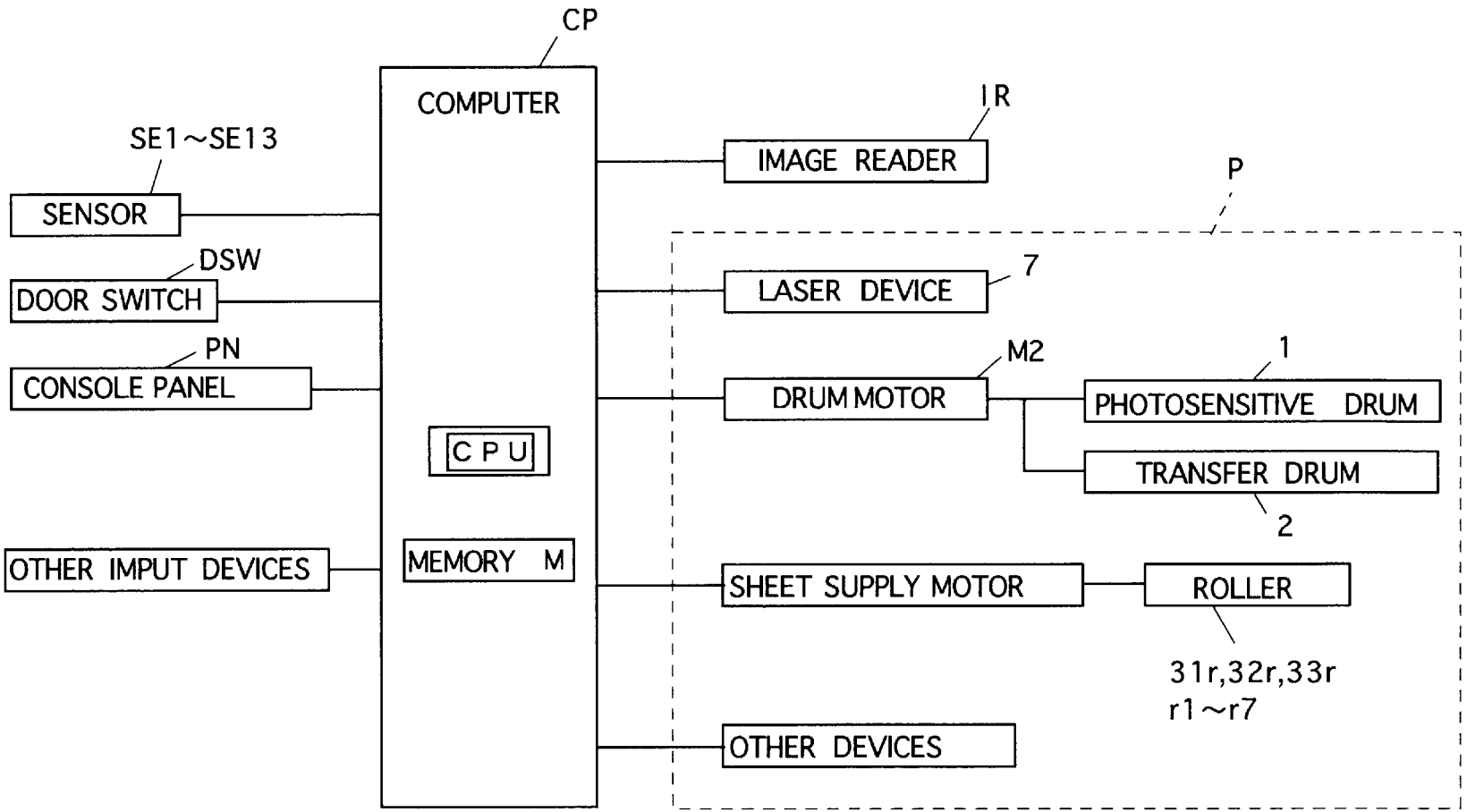
FIG. 2 is a block diagram of a control circuit of the copying machine shown in FIG. 1.

FIG. 2 is a block diagram of a control circuit of the copying machine described above.

The copying machine includes the computer CP, which has central processing unit CPU and a memory M, and controls operations of the devices already described based on the information supplied from the sensors SE1–SE13. The copying machine is provided with a console panel PN (not shown in FIG. 1), through which a user can instruct the start of copying and can set the number of sheet for copying. The console panel PN is also connected to the computer CP.

A full-color copying operation of the copying machine described above will be briefly described below.

Among Several kinds of original image data which correspond to the respective colors (C, M, Y and Bk) of the original image read by the image reader IR, the image data of the first color (cyan (C) in this embodiment) is first supplied to the laser device 7. The laser device 7 emits the laser beam corresponding to the cyan of the original image to the photosensitive drum 1 based on the supplied data, and thereby the electrostatic latent image corresponding to the cyan of the original image is formed on the photosensitive drum 1, which is already charged uniformly by the charger 11 and is being driven to rotate clockwise in FIG. 1.

This electrostatic latent image is developed into a cyan toner image by the developing device 12C accommodating the cyan toner.

Meanwhile, the sheet accommodated, e.g., in the sheet tray 31 is fed to the transporting path 82 by the roller 31r through the transporting path 811, and is transported by the roller pairs r1 and r2 to the sheet attraction position where the electrostatic charger 21 and the attraction roller 27 are opposed to each other. At this position, the sheet is electrostatically attracted onto the outer surface of the transfer film 20, which is driven to rotate counterclockwise in FIG. 1, by the attraction charger 21 and the attraction roller 27 with the aid of the attraction backup film 28 which is pressed against the inner side of the transfer film 20 to push up the same slightly. Although the sheet accommodated in the tray 31 is attracted onto the transfer film 20 in the above description, the sheet accommodated in the tray 32 or 33 may be attracted thereto. The sheet tray accommodating the sheet to be supplied is selected by the user through a sheet select key or the like (not shown) arranged on the panel N.

The cyan toner image which was formed on the photosensitive drum 1 in the foregoing manner is transferred by the transfer charger 22 onto the sheet attracted onto the transfer film 20. The timing roller pair r2 supplies the sheet to the sheet attraction position so as to form the toner image on the accurate position on the sheet.

Thereafter, the operations are performed similarly to the above operation for the first color, and thus formation of the electrostatic latent images of the second (magenta), third (yellow) and fourth (black) colors, development of the electrostatic latent images and transfer of the developed toner images onto the sheet are performed. Therefore, the sheet attracted onto the transfer film 20 are kept on the film until it turns several times required for obtaining the final multiple toner images.

The sheet carrying the transferred toner images of cyan, magenta, yellow and black are set to a state allowing easy separation from the outer surface of the transfer film 20 by the separator charger 23, and is separated from the film 20 by the separator claw 24 which comes into contact with the film 20. Then, the sheet is fed to the fixing device 4. In the fixing device 4, the sheet passes through a nip formed between the heating roller 41 heated to a predetermined fixing temperature and the pressing roller 42 pressed against the roller 41, during which the toner images are fixed to the sheet by the heat and pressure.

When single-side copying is to be performed, the sheet carrying the toner images fixed thereto is led by the claw 35, and is discharged onto the tray 34. When double-side copying is to be performed, the sheet carrying the fixed toner images is led to the sheet resupplying and inverting unit 5 by the claw 35, and is transported to the sheet attraction position again after being inverted. Then, the toner images of the four colors are transferred onto the rear (second) surface of the sheet in the same manner, and are fixed onto the sheet. Then, the sheet is discharged onto the discharge tray 34.

In the copying machine described above, the copying machine is disabled to perform the copying operation when a trouble such as jamming is detected. Information relating to the trouble is stored in the memory M of the computer CP, and one can know the information even after the trouble is overcome. The copying disabled state represents a state that the copying is not executed even when the user depresses the copy start key (i.e., key for instructing start of the copying) arranged on the console panel PN.

The user, serviceman or the like removes a cause of the trouble through an area opened by opening the door D. When the trouble is solved, three kinds of preliminary processing, i.e., (1) checking of residual sheet on the transfer drum, (2) image stabilizing processing (toner density optimizing processing) and (3) transfer drum cleaning, which will be described later in detail, are performed before the copying machine changes from the copying disabled state to the copying enabled state (i.e., the state that the copying is executed when the copy start key is depressed). These kinds of preliminary processing are performed for normally and correctly performing the next copying operation which will be performed when the copying machine is enabled to perform the copying operation. Selection of these kinds of preliminary processing (1)–(3) to be performed actually is determined by the computer CP based on the contents stored in the memory M of the computer CP and relating to the trouble which caused the disabled state of the copying machine, as will be described later in detail. The preliminary processing (1)–(3) will now be specifically described below.

(1) Check of the Residual Sheet on the Transfer Drum

The check of the residual sheet on the transfer drum 2 is performed for confirming that the sheet which may remain on the transfer film 20 due to, e.g., jamming is not present on the transfer film 20, and confirming that the next copying can be performed normally and correctly.

More specifically, the transfer drum 2 is rotated, and an LED (not shown) of the sensor SE6 emits light upon when a predetermined time elapses after input from the sensor SE7 detecting the transfer drum reference position. In this manner, the reflected light beams are sampled. When there is a reflected light beam, it is determined that a sheet is still remaining on the transfer film 20. As described above, the transfer drum 2 is driven to rotate for sampling by the sensor SE6 because of the following fact. The attracted sheet does not fully cover the outer surface of the transfer sheet 20. Therefore, if the operation for detecting the sheet by the sensor SE6 were performed without moving the transfer film 20, the sheet present on the transfer film 20 would not be detected in some cases. For preventing this, the transfer film 20 is rotated during the detecting operation.

(2) Image Stabilizing Processing (Processing for Optimizing the Toner Density)

The image optimizing processing is performed for the purpose of optimizing the density of the image which is formed on the first sheet, for example, after power-on or after closing the door D which was opened for recovery from the trouble such as jamming.

This preliminary processing is performed as follows. A toner pattern is formed on the photosensitive drum 1, which is being driven to rotate, under predetermined conditions, and the AIDC sensor SE13 reads the density of the toner pattern to provide the density information. The image forming conditions is for the next copying operation such as a developing bias voltage and a quantity of laser light beams emitted from the laser device 7 are determined based on the density information thus provided.

(3) Cleaning of the Transfer Drum

Cleaning of the transfer drum 2 is performed for removing toner adhered onto the transfer film 20 and residual charges which are present after repetition of the copying operation. If the transfer drum 2 is not cleaned up, the toner may smear the sheet surface attracted onto the transfer film 20. The cleaning of the transfer drum is performed at the time of automatic shut-off after the copying. However, the cleaning to be performed at the time of the automatic shut-off is not performed when the copying is not normally completed due to jamming or the like and thereby the copying machine is disabled. In this case, the cleaning is performed as the preliminary processing.

Figure 3:
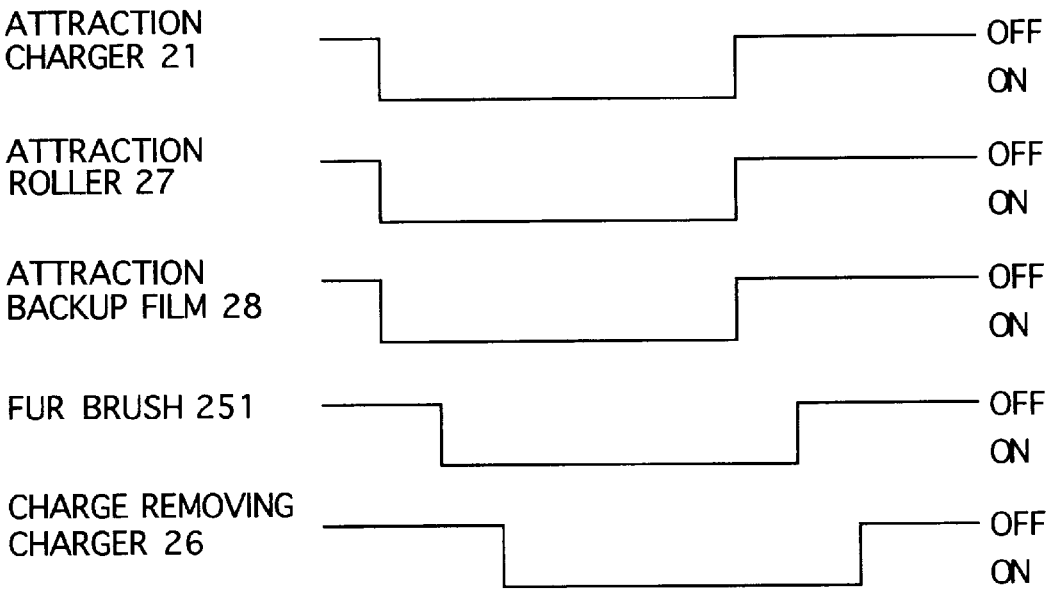
FIG. 3 shows an example of an operation sequence for cleaning a transfer drum.

More specifically, the transfer drum 2 is rotated, and is cleaned up by operating the attraction charger 21, the attraction roller 27, the attraction backup film 28, the fur brush 251 of the fur brush unit 25 and the charge removing charger 26 in accordance with a sequence shown in FIG. 3.

In FIG. 3, ON/OFF of the attraction roller 27 represent on/off of its rotational driving. ON/OFF of the fur brush 251 represent on/off of its rotational driving as well as pressing and spacing with respect to the transfer film 20. ON/OFF of the attraction backup film 28 represent pressing and spacing with respect to the transfer film 20.

First, the attraction charger 21, the attraction roller 27 and the attraction backup film 28 recharge the transfer film 20. Then, the fur brush 251 collects the toner on the transfer film 20, and finally removes the residual charges at the inner and outer sides of the transfer film 20 by the charge removing charger 26 to restore the transfer film 20 to the initial state.

Description will be given on specific cases requiring the above preliminary processing, i.e., (1) check of the residual sheet on the transfer drum, (2) processing for image stabilization and (3) cleaning of the transfer drum.

(A) In the case where the jamming is intentionally caused by remaining the sheet, on which an image is formed, on the transfer film 20 for adjustment of the copying machine.

The purpose of forcedly (intentionally) causing the jamming is to determine the attraction position of the sheet on the transfer film 20 and the position of the formed image on the sheet, and thereby adjusting these positions. These determination and adjustment are usually performed by a person at a production line after assembly of the copying machine, or by a serviceman for maintenance of the copying machine, and are not performed by general users. In this case, therefore, the sheet remained of the transfer film 20 is generally removed without fail. In this case, therefore, the check of the residual sheet on the transfer drum is not performed. The copying machine has an adjustment mode, which is not opened to general users, for the foregoing determination and adjustment. The computer CP determines and detects the jamming as the jamming occurred in this adjustment mode.

After the above position adjustment, the positions may be determined again. In this case, processing for stabilizing the image is not performed even if the density of the image formed on the sheet is not accurate, because this confirmation is performed only for the positions. In the above adjustment mode, the transfer drum 2 is not cleaned up because there is little possibility of smearing of the transfer drum 2.

In the case where the jamming is caused for determining and adjusting the sheet attraction position and the position of the image on the sheet, therefore, no preliminary processing is performed, and the copying machine is rapidly restored to the copying enabled state. If the determination or the like is to be performed again, the operation for the same can be performed more rapidly than the prior art, and the time for adjustment can be reduced.

(B) In the case where jamming occurred before the sheet is attracted onto the transfer film 20 during the single copying operation (i.e., copying for the single sheet) or during copying for the first sheet in the multiple copying operation (i.e., copying for multiple sheets).

The computer CP is provided with a counter, which indicates the number of sheets already copied and being copied, and is incremented by one upon every completion of the copying for one sheet. The counter indicates the current number of the sheets already copied and being copied. When the counter indicates that copying for the first sheet is being performed, the sensors SE1, SE2, SE3, SE4 and/or SE5, which are arranged near the transporting path upstream to the sheet attraction position in the sheet transporting direction, may detect that a sheet is present on the transporting path opposed to these sensors. In this case, the computer CP determines that the jamming occurred.

In this case, it is clear that no sheet is present on the transfer film 20. Therefore, check of the residual sheet on the transfer drum is not performed. Since image formation is not performed after the last preliminary processing, the transfer film 20 is not smeared, and the transfer drum is not cleaned up. In this case, only the processing for image stabilization is performed.

(C) In the case where jamming occurred when the sheet is being discharged from the copying machine during the single copying operation or during the copying operation for the last sheet in the multiple copying operation.

When the counter indicates that the copying for the last sheet is being performed, and the sensor SE9 arranged upstream to the discharge tray 34 in the sheet transporting direction detects the presence of the sheet, the computer CP determines that the foregoing jamming occurred.

In this case, no sheet remains on the transfer film 20, but smear may be present on the transfer film 20 due to transfer of the toner image onto the sheet attracted onto the transfer film 20 after the last preliminary processing. Therefore, only the cleaning of the transfer drum and image stabilization are performed.

(D) In the case where the jamming occurred within the sheet resupplying and inverting unit 5

When the sensors SE10, SE11 or SE12 opposed to the transporting path of the unit 5 detects the presence of the sheet, the computer CP determines that the above jamming occurred.

In this case, no sheet remains on the transfer film 20, but smear may be present on the transfer film 20 due to transfer of the toner image onto the sheet attracted onto the transfer film 20 after the last preliminary processing. Therefore, only the cleaning of the transfer drum and image stabilization are performed.

(E) In the case of jamming other than the foregoing cases.

In the case other than the above, the jamming may occur due to the fact that the sheet is not correctly attracted onto the transfer film 20, or that the sheet is not correctly separated from the transfer film 20. The sensor SE6 detects the jamming caused by incorrect attraction, and the sensor SE8 detects the jamming caused by incorrect separation.

In this case, it is necessary to determine whether the sheet is correctly removed from the transfer film 20 or not, and there is a possibility that the transfer film 20 is smeared. Therefore, all kinds of preliminary processing, i.e., check of the residual sheet on the transfer drum, cleaning of the transfer drum and image stabilization are performed.

(F) In the case of a trouble occurred during standby, i.e., when the copying is not being performed.

The trouble during standby is, for example, burnt-out of a main eraser 14 which is provided for erasing residual charges after transfer of the toner image from the photosensitive drum 1. Burnt-out of the main eraser 14 is checked by flowing a minute current through the main eraser 14 while the main eraser 14 is off. Therefore, this trouble occurs during standby.

In this case, no sheet is present on the transfer film 20, and smear is not present on the transfer drum 20 so that only the processing for image stabilization is performed.

(G) In the case where the copying machine is adjusted in the copying machine adjustment mode without transporting the sheet.

For example, the adjustment of the copying machine without transportation of the sheet is performed for adjusting the ATDC sensor. The adjustment of the ATDC sensor is performed to set the toner density, which is detected by the ATDC sensor in the form of a voltage signal, to a predetermined value when new developer having a known density, i.e., so-called starter is supplied to the developing device.

In this case, no sheet is present on the transfer film 20, and the transfer film 20 is not smeared. Also, control of the image density is not required. Therefore, the copying machine is enabled without performing any preliminary processing.

(H) In the case of a trouble other than those already described.

Troubles in the case other than the above occur during the copying operation, and specifically may be such troubles that the motor (e.g., drum motor M2 for driving the photosensitive drum 1 and the transfer drum 2) does not operate correctly, and that a current leak occurs at a charger (e.g., charger 11).

In these cases, all kinds of preliminary processing are performed.

The following table 1 shows execution and non-execution of the three kinds of preliminary processing, i.e., check of residual sheet on the transfer drum (CHECK), processing for stabilizing the image (STABILIZATION) and cleaning of the transfer drum (CLEANING) in each of the cases (A)–(H). In the table 1, "O" represents execution, and "X" represents nonexecution.

TABLE 1

| | CHECK | STABILIZATION | CLEANING |
|---|---|---|---|
| (A) | X | X | X |
| (B) | X | O | X |
| (C) | X | O | O |
| (D) | X | O | O |
| (E) | O | O | O |
| (F) | X | O | X |
| (G) | X | X | X |
| (H) | O | O | O |

Figure 4:
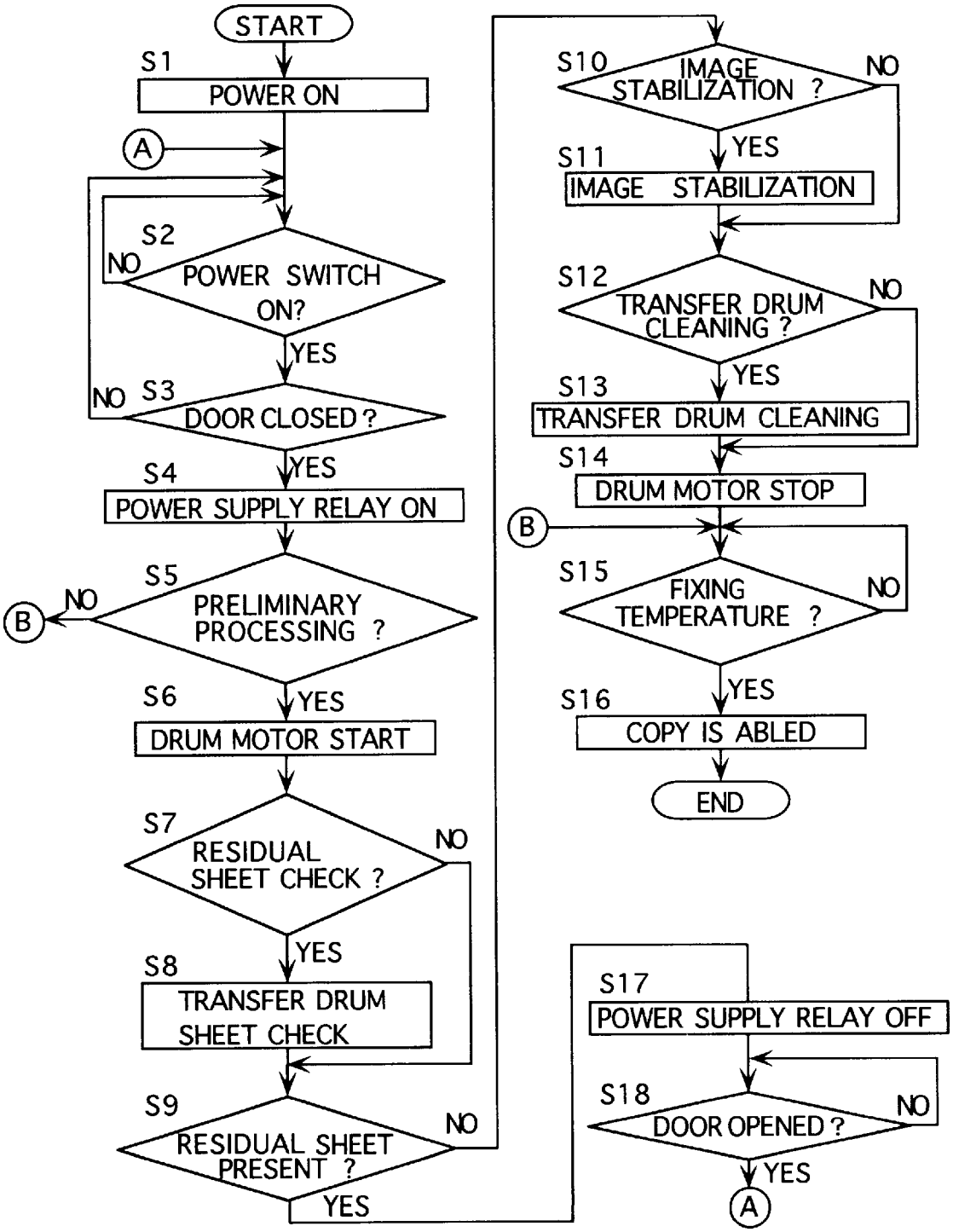
FIG. 4 is a flow chart showing contents of an operation performed by a computer for preliminary processing.

Referring to FIG. 4 which is a flowchart relating to the preliminary processing, description will be given on a manner in which the copying machine operates after the trouble occurred.

After power-on (step S1 in FIG. 4), it is confirmed that the power switch is on and the door D is closed (S2 and S3), and a power supply relay is turned on (S4).

Then, it is determined whether or not it is necessary to perform at least one kind of preliminary processing, i.e., at least one of the check of residual sheet on the transfer drum, stabilization of the image and cleaning of the transfer drum (S5).

When the trouble occurred in the foregoing case (A) or (G) (S5: NO), no preliminary processing is required, so that the copying machine is enabled after the fixing device 4 is controlled to a predetermined fixing temperature (S15).

When the trouble occurred in the case other than foregoing case (A) and (G), and appropriate preliminary processing is required (S5: YES), the drum motor M2 starts to rotate the photosensitive drum 1 and the transfer drum 2 (S6).

Then, it is determined whether check of the residual sheet on the transfer drum is necessary or not (S7). If necessary, check of the residual sheet on the transfer drum is performed (S8). This is required when the trouble occurred in the foregoing case (E) or (H). When it is detected that the sheet remains on the transfer film 20 (S9: YES), the power supply relay is turned off (S17) to stop all the control loads, and it is confirmed that the door D is opened to allow access for troubleshooting (S18). Then, the processing restarts from the step S2. Usually, the user, serviceman or the like perform the troubleshooting during a period from opening of the door D to closing.

When it is confirmed that no sheet remains on the transfer film 20 (S9: NO), it is then determined that the processing for stabilizing the image is necessary or not (S10). If necessary, the processing for stabilizing the image is performed (S11). This is required when the trouble occurred in the foregoing case (B), (C), (D), (E), (F) or (H).

It is determined whether cleaning of the transfer drum is necessary or not (S12). If necessary, cleaning of the transfer drum is performed (S13). This is required when the trouble occurred in the case of (C), (D), (E) or (H).

When necessary preliminary processing is completed, the drum motor stops (S14), and the copying machine is enabled to perform the (copying operation (S16) after the roller of the fixing device 4 attains the predetermined temperature (S15).

According to the copying machine, as described above, several kinds of preliminary processing can be performed for normally performing the subsequent copying operation and correctly forming the image in the subsequent copying operation, when the copying machine stops due to a trouble. Particularly, several kinds of preliminary processing, i.e., check of the residual sheet on the transfer drum, stabilization of the image and cleaning of the transfer drum are selected to perform only the processing required depending on the actual trouble or the like. In other words, unnecessary kinds of preliminary processing are not performed. Therefore, the copying machine can be rapidly restored to the state capable of performing the normal and correct copying operation. Therefore, the copying machine allows easy use.

The full-color copying machine having the transfer drum has been described as an example of the structure to which the invention is applied. The invention can be applied to image forming apparatuses having sheet carrying members such as a monochrome copying machine, a monochrome printer and a full-color printer having structures similar to that already described.

The invention can be applied to an image forming apparatus such as a printer or a copying machine not provided with a sheet carrying member such as a transfer drum. Even in this case, the apparatus can operate to perform only a necessary kind(s) of preliminary processing and, in order words, can operate not to perform unnecessary kind(s) of preliminary processing. Therefore, a time required for the preliminary processing is reduced so that the image forming apparatus can be rapidly restored to the image formation enabled state.

In the case of the image forming apparatus, wherein an electrostatic latent image is formed on an electrostatic latent image carrier based on original image information, the electrostatic latent image is developed into a tone image and the toner image is transferred directly onto the sheet, the preliminary processing may be the stabilization of the image already described.

The invention may be applied to an apparatus wherein electrostatic latent images in respective colors (e.g., cyan, yellow, magenta and black) corresponding to the original image are successively formed on the electrostatic latent image carrier based on original image information, a developing device corresponding to one of the colors develops the electrostatic latent image of the same color to form the toner image of the same color on the electrostatic latent image carrier every time the image is formed, the toner image is transferred onto an intermediate transfer member such as an intermediate transfer belt to complete multiple toner images formed of the toner images of the respective colors on the intermediate transfer member, and thereafter the multiple toner images are transferred onto the sheet. In this case, the preliminary processing is, for example, the image stabilization and cleaning of the intermediate transfer member described above.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus wherein a toner image is electrophotographically formed on a record sheet based on original image information and wherein a plurality of kinds of preliminary processing can be performed by the apparatus before switching to an image formation enabled state from an image formation disabled state caused by one of a plurality of kinds of trouble in the apparatus and wherein the preliminary processing is performed after the trouble has been resolved, comprising:

a detecting device for detecting the kind of trouble causing said image formation disabled state of the image forming apparatus;

a memory for storing the kind of trouble detected by said detecting device; and a preliminary processing determining portion for determining the kind of preliminary processing to be performed based on the kind of the trouble stored in said memory.

2. The image forming apparatus of claim 1, further comprising means for performing the preliminary processing.

3. An image forming apparatus wherein a toner image is electrophotographically formed on a record sheet based on original image information and wherein a plurality of kinds of preliminary processing can be performed by the apparatus before switching to an image formation enabled state from an image formation disabled state caused by one of a plurality of kinds of trouble in the apparatus and wherein the preliminary processing is performed after the trouble has been resolved, comprising:

a detecting device for detecting the kind of trouble causing said image formation disabled state of the image forming apparatus;

a trouble determining portion for determining whether the kind of trouble detected by said detecting device occurred in an adjustment mode for adjusting the image forming apparatus; and a preliminary processing determining portion for determining the kind of preliminary processing to be performed based on the kind of the trouble stored in said memory.

4. The image forming apparatus of claim 3, further comprising means for performing the preliminary processing.

5. An image forming apparatus wherein an electrostatic latent image is formed on an electrostatic latent image carrier based on original image information, the electrostatic latent image is developed into a toner image, the toner image is transferred onto a record sheet carried on a surface of a sheet carrying member opposed to the electrostatic latent image carrier, and the toner image based on the original image is formed on said record sheet, and wherein a plurality of kinds of preliminary processing can be performed by the apparatus before switching to an image formation enabled state from an image formation disabled state caused by one of a plurality of kinds of trouble in the apparatus and wherein the preliminary processing is performed after the trouble has been resolved, comprising:

a detecting device for detecting the kind of trouble causing said image formation disabled state of the image forming apparatus;

a memory for storing the kind of trouble detected by said detecting device; and a preliminary processing determining portion for determining the kind of preliminary processing to be performed based on the kind of the trouble stored in said memory.

6. The image forming apparatus according to claim 5, wherein said preliminary processing includes sheet detection processing for determining whether the record sheet is present on said sheet carrying member or not.

7. The image forming apparatus according to claim 6, wherein said sheet carrying member is an endless rotary member and is driven to rotate by a drive device, a sensor of a reflection type is opposed to said sheet carrying member, said sheet detection processing is performed to detect presence/absence of the record sheet with said reflection sensor while rotating said sheet carrying member by said drive device.

8. The image forming apparatus according to claim 5, wherein said preliminary processing includes toner density optimizing processing for optimizing a toner density of said toner image formed on the record sheet.

9. The image forming apparatus according to claim 8, further comprising:

a density detecting device opposed to said electrostatic latent image carrier for detecting the density of the toner image formed on said electrostatic latent image carrier, wherein said processing for optimizing the toner density is performed such that a toner pattern is formed on said electrostatic latent image carrier under predetermined image forming conditions, said density detecting device detects the density of said toner pattern, and image formation conditions for intended image formation are determined based on the detected density of the toner pattern.

10. The image forming apparatus according to claim 5, wherein said preliminary processing includes cleaning processing for cleaning up said sheet carrying member.

11. The image forming apparatus according to claim 10, further comprising:

a toner removing device for removing toner adhered onto the surface of said sheet carrying member and/or a charge erasing device for erasing residual charges on the surface of said sheet carrying member, wherein said processing for cleaning is performed such that said toner removing device removes the toner adhered onto the surface of said sheet carrying member, and/or said charge erasing device erases the residual charges on the surface of said sheet carrying member.

12. The image forming apparatus of claim 5, further comprising means for performing the preliminary processing.

13. An image forming apparatus wherein an electrostatic latent image is formed on an electrostatic latent image carrier based on original image information, the electrostatic latent image is developed into a toner image, the toner image is transferred onto a record sheet carried on a surface of a sheet carrying member opposed to the electrostatic latent image carrier, and the toner image based on the original image is formed on said record sheet, and wherein a plurality of kinds of preliminary processing can be performed by the apparatus before switching to an image formation enabled state from an image formation disabled state caused by one of a plurality of kinds of trouble in the apparatus and wherein the preliminary processing is performed after the trouble has been resolved, comprising:

a detecting device for detecting the kind of trouble causing said image formation disabled state of the image forming apparatus;

a memory for storing the kind of trouble detected by said detecting device; and a preliminary processing determining portion for determining the kind of the preliminary processing to be performed based on the state of the trouble stored in said memory, said preliminary processing determining portion selecting the preliminary processing to be performed from one of a sheet detection processing for detecting whether the record sheet is present on said sheet carrying member or not, toner density optimizing processing for optimizing the density of said toner image formed on the record sheet, and cleaning processing for cleaning said sheet carrying member.

14. The image forming apparatus according to claim 13, wherein said sheet carrying member is an endless rotary member and is driven to rotate by a drive device, a sensor of a reflection type is opposed to said sheet carrying member, said sheet detection processing is performed to detect presence/absence of the record sheet with said reflection sensor while rotating said sheet carrying member by said drive device.

15. The image forming apparatus according to claim 13, further comprising:

a density detecting device opposed to said electrostatic latent image carrier for detecting the density of the toner image formed on said electrostatic latent image carrier, wherein said processing for optimizing the toner density is performed such that a toner pattern is formed on said electrostatic latent image carrier under predetermined image forming conditions, said density detecting device detects the density of said toner pattern, and image formation conditions for intended image formation are determined based on the detected density of the toner pattern.

16. The image forming apparatus according to claim 13, further comprising:

a toner removing device for removing toner adhered onto the surface of said sheet carrying member and/or a charge erasing device for erasing residual charges on the surface of said sheet carrying member, wherein said processing for cleaning is performed such that said toner removing device removes the toner adhered onto the surface of said sheet carrying member, and/or said charge erasing device erases the residual charges on the surface of said sheet carrying member.

17. The image forming apparatus according to claim 13, further comprising:

a sheet transporting device capable of transporting the record sheet from a sheet accommodating position, at which the record sheet for forming the toner image thereon is accommodated, to a sheet carrying position, at which the record sheet is carried on said sheet carrying member, and transporting said record sheet carried on said sheet carrying member to a sheet discharge position outside said image forming apparatus after formation of said toner image on the record sheet.

18. The image forming apparatus according to claim 17, wherein said preliminary processing determining portion determines that no preliminary processing is to be performed when said memory stores, as said trouble, jamming forcedly caused during an operation of adjusting the position of the record sheet on the surface of said sheet carrying member and adjusting the position of the toner image on said record sheet.

19. The image forming apparatus according to claim 17, wherein said preliminary processing determining portion determines that said toner density optimizing processing is to be performed, when said memory stores, as the trouble, jamming which occurred during transportation of a first sheet from said sheet accommodating position to said sheet carrying position by said sheet transporting device for the image formation on the first sheet.

20. The image forming apparatus according to claim 17, wherein said preliminary processing determining portion determines that said toner density optimizing processing and said cleaning processing are to be performed, when said memory stores, as the trouble, jamming which occurred during transportation of the last sheet from said sheet carrying member to said sheet discharging position by said sheet transporting device for the image formation on the last sheet.

21. The image forming apparatus according to claim 17, wherein said sheet transporting device includes a device for inverting and transporting the record sheet to said sheet carrying position after said toner image is formed on the record sheet, and said preliminary processing determining portion determines that said toner density optimizing processing and said cleaning processing are to be performed, when said memory stores, as the trouble, jamming which occurred during transportation of the record sheet to said sheet carrying position by said sheet transporting device after inverting the record sheet.

22. The image forming apparatus according to claim 17, wherein said preliminary processing determining portion determines that said toner density optimizing processing is to be performed, when said memory stores, as the foregoing trouble, a trouble which was detected by said detecting device while the image formation was not being performed.

23. The image forming apparatus according to claim 17, wherein said preliminary processing determining portion determines that no preliminary processing is to be performed, when said memory stores, as the foregoing trouble, a trouble caused during adjustment of the image forming apparatus which was carried out without performing transportation of the record sheet by said sheet transporting device.

24. The image forming apparatus of claim 13, further comprising means for performing the preliminary processing.

* * * * *